US010667552B2

(12) United States Patent
Ball

(10) Patent No.: US 10,667,552 B2
(45) Date of Patent: Jun. 2, 2020

(54) PASSIVELY COOLED PIPE

(71) Applicant: Temple Kraft, LLC, Portland, OR (US)

(72) Inventor: Kenneth Ball, Portland, OR (US)

(73) Assignee: Temple Kraft, LLC, Portland, OR (US)

( * ) Notice: Subject to any disclaimer, the term of this patent is extended or adjusted under 35 U.S.C. 154(b) by 351 days.

(21) Appl. No.: 15/458,859

(22) Filed: Mar. 14, 2017

(65) Prior Publication Data

US 2018/0263279 A1 Sep. 20, 2018

(51) Int. Cl.

| | |
|---|---|
| ***A24F 1/22*** | (2006.01) |
| ***A24F 1/32*** | (2006.01) |
| ***A24F 1/16*** | (2006.01) |

(52) U.S. Cl.

CPC ..... *A24F 1/22* (2013.01); *A24F 1/16* (2013.01); *A24F 1/32* (2013.01)

(58) Field of Classification Search

None

See application file for complete search history.

(56) References Cited

U.S. PATENT DOCUMENTS

2017/0055571 A1* 3/2017 Reyes ..... A24F 1/32

* cited by examiner

*Primary Examiner* — Michael J Felton
*Assistant Examiner* — Katherine A Will
(74) *Attorney, Agent, or Firm* — Klarquist Sparkman, LLP

(57) ABSTRACT

A passively cooled pipe made of a material with a high coefficient of thermal conductivity that has a lockable, invertable, combustion bowl/storage compartment. The pipe is designed for the combustion of dry organic matter. It has a series of passive radiator fins about the outer faces of its sides for the dissipation of heat there along its body, and an aggressive smoke mixing design in the bore of the shank section that aids in the removal of tar and smoke particles. The inside volume of the shank also has a series of passive radiator fins in operational contact with the sides of the shank. There is a removable locking tool housed in the passive radiator fins on one of the outer faces, used to lock the combustion bowl in either of its positions. The locking tool also disassembles the two halves of the pipe for cleaning.

20 Claims, 8 Drawing Sheets

6
16

10
6
9
4

11
11
11
4
14

PASSIVELY COOLED PIPE

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to delivery devices of the smoke generated from combusting dry, organic and inorganic matter, and more particularly to passively cooled smoking technology.

BACKGROUND

In all devices for smoking dry, inorganic and organic material there is the requirement of a heat source to initiate and possibly propagate combustion of the material. This source of heat is commonly from a flame or an electric resistance element directed onto or into a combustion chamber (located within the pipe bowl) that holds a slug of material for combustion. This necessary combustion heat has two side effects. First, it heats up the charge such that there must be a length or distance between the combustion bowl outlet (draw hole) and the mouthpiece, sufficient to allow the smoke charge to cool enough to prevent discomfort at the users mouth or lungs. Second, it slowly transfers heat from the combustion bowl to the remainder of the device as the heated smoke passes down the bore (from the draught hole to the lip) further exacerbating the first condition and making the device uncomfortable to hold and uncomfortable on the lips.

Many conventional pipes use a water cooling system or an ice packed recess to drop the temperature of the smoke charge, however, these devices are not portable, not concealable, require a fluid and regular cleaning. To date the problem has generally been remedied by allowing a sufficient amount of time for cooling between combustions. This makes use a lengthy procedure when there is multiple users, and the device large and cumbersome.

As a final drawback to conventional pipes, tar and smoke particles build up in the smoke passage choking off the flow path, or alternatively, the pipe allows an excess of the tar and smoke particles to exit the pipe.

Thus, a pipe with a more efficient cooling system in a smaller profile, as provided by the embodiments set forth below, would be a welcomed improvement to the pipe smoking industry.

BRIEF SUMMARY

In accordance with various embodiments, a passively cooled delivery device for smoke generated from combusting dry, organic and inorganic matter is provided. It has an invertable bowl that doubles as a storage compartment and is lockable in either configuration with a locking tool.

In one aspect, a compact, cleanable pipe having a passive cooling system incorporated thereon and configured in a small profile that can be readily disassembled and cleaned, is provided.

In another aspect, a pipe with a finned passive radiator design incorporated on the entire inside and entire outside surfaces thereof, wherein the pipe is made of a suitably thermally conductive material is provided.

In yet another aspect, a pipe external passive cooling system is provided capable of aggressive smoke mixing in the bore of the shank section while allowing maximum cooling.

In yet another aspect, a pipe having a two piece shank that can be disassembled by a locking tool housed in the passive radiator fins on the outside of the shank.

In yet another aspect, a pipe able of removing a high percentage of the tars, nicotine and smoke particulate from the pipe's combusted material, is provided.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components. In some instances, a sub-label is associated with a reference numeral to denote one of multiple similar components. When reference is made to a reference numeral without specification to an existing sub-label, it is intended to refer to all such multiple similar components.

DETAILED DESCRIPTION OF CERTAIN EMBODIMENTS

Figure 1:
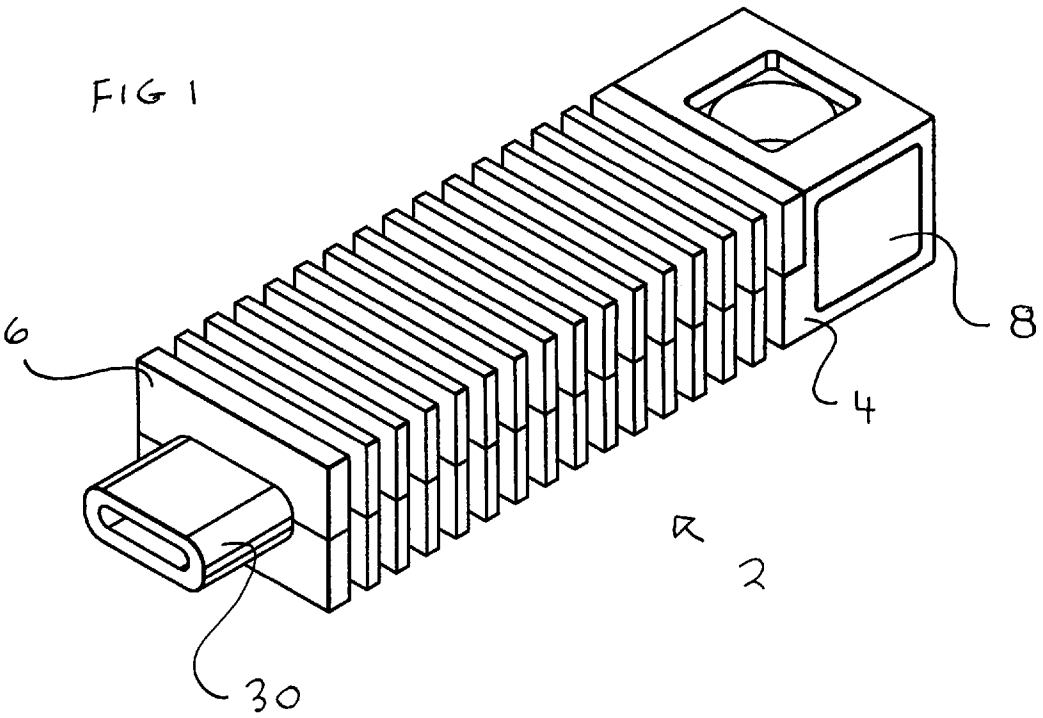
FIG. 1 is a top perspective view of the pipe.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. In other instances, certain structures and devices are shown in block diagram form. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

As used herein, the term "slug" refers to the mass of combustible material inserted into the pipe bowl for combustion. This is generally organic material such as tobacco although it can be inorganic material.

As used herein the term "charge" refers to a volume of smoke generated by the combustion of a slug within the bowl of the pipe and that is transferred out of the bowl through the draught hole and into the bore.

As used herein, the term "passive cooling" refers to a method or device for heat dissipation (cooling) that uses no moving or mechanically active components. An example of such a device is a finned automobile radiator.

As used herein, the term "coefficient of thermal conductivity" can be defined as "the quantity of heat transmitted through a unit thickness of a material—in a direction normal to a surface of unit area—due to a unit temperature gradient under steady state conditions." Thermal conductivity units is W/(m K) in the SI system and Btu/(hr ft ° F.) in the Imperial system. Aluminum has a coefficient of thermal conductivity of 205 Btu/(hr ft ° F.) at 77 degrees F. Any material with a coefficient of thermal conductivity greater than 40 Btu/(hr ft ° F.) at 77 degrees F. would be considered to be a good substitute for the preferred embodiment material of aluminum.

System components described according to a particular structural architecture and/or with respect to one system may be organized in alternative structural architectures and/or incorporated within other described systems. Hence, while various embodiments are described with—or without—certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

The present invention relates to a novel design for an improved passively cooled pipe. It enables a new level of efficiency in the cooling of a heated smoke charge as it is drawn from the draught hole of the pipe's combustion chamber along the shank through the bore to the lip of the mouthpiece. The pipe including the bowl, is constructed of materials having high thermal conductivities. In the preferred embodiment, the pipe body is fabricated from aluminum, with the removable combustion chamber fabricated from brass, the assembly mechanical fasteners and locking mechanical fasteners fabricated from stainless steel and the locking tool made of hardened steel. Other materials will also work (provided they have a high enough coefficient of thermal conductivity) but those of the preferred embodiment achieve an optimal performance with an aesthetic appeal.

Looking at FIG. 1 it can be seen that the passively cooled pipe 2 has a geometric configuration of an externally finned, rectangular cylinder with a mouthpiece 30 extending from its proximal end along the longitudinal axis of the pipe 2, and a bowl 8 slidingly inserted into a matingly conformed axial through-recess at its distal end.

Figures 2, 3, 4:
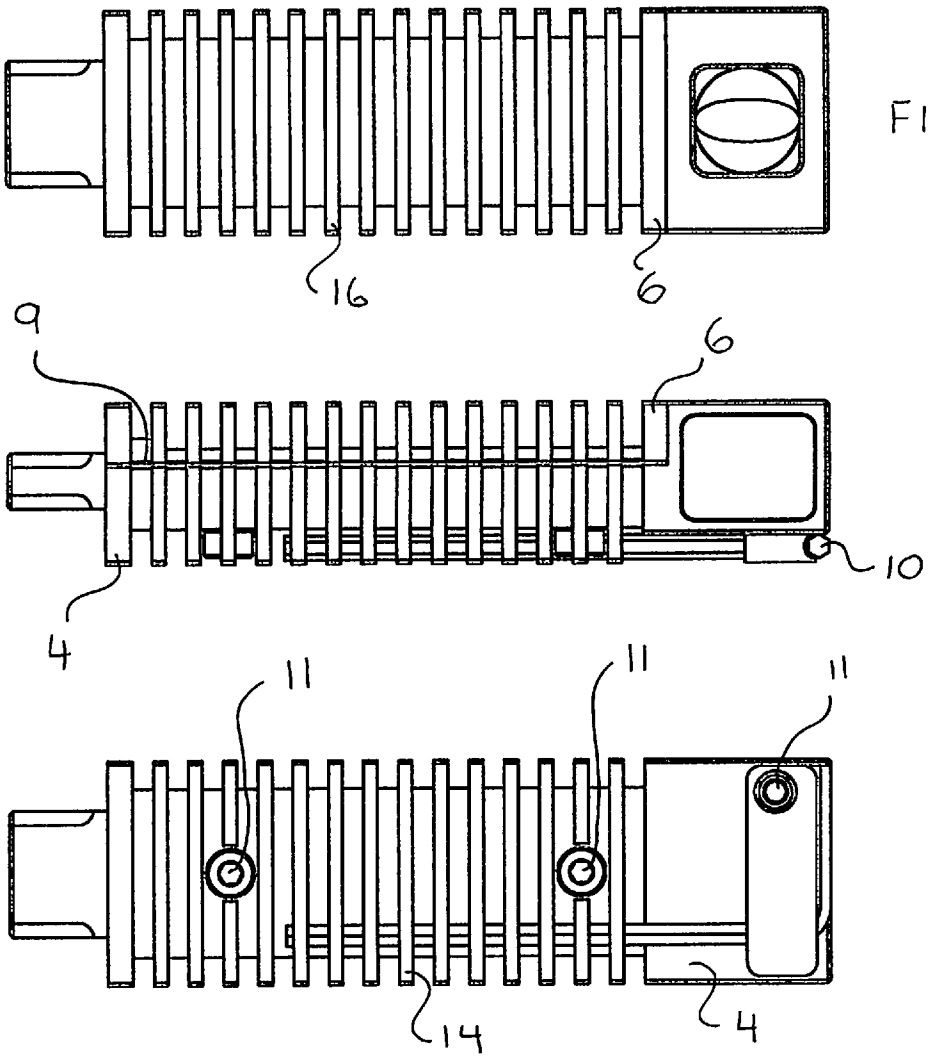
FIG. 2 is a top view of the pipe.
FIG. 3 is a right side view of the pipe.
FIG. 4 is a bottom view of the pipe.

The FIGS. 2-4 show top, side and bottom views of the assembled pipe 2. Here it can be seen the pipe 2 has a body 4 and a top plate 6 that are matingly coupled via first mechanical fasteners 8 (preferably two hex socket head screws). The body 4 has a series of parallel body external fins 14 extending normally (axially) from the body 4. Similarly, the top plate 6 has a series of parallel top plate external fins 16 extending normally (axially) from the top plate 6. They each have the same number of external fins and when assembled these fins align so as to form a series of uninterrupted parallel fins that encircle the pipe 2 along its longitudinal axis. An optional locking tool 10 (preferably a kex key) is securely affixed along the bottom of the pipe 2 by frictional insertion into a series of aligned orifices in the body outer fins 14 that run parallel to the linear axis of the pipe 2.

Figure 5:
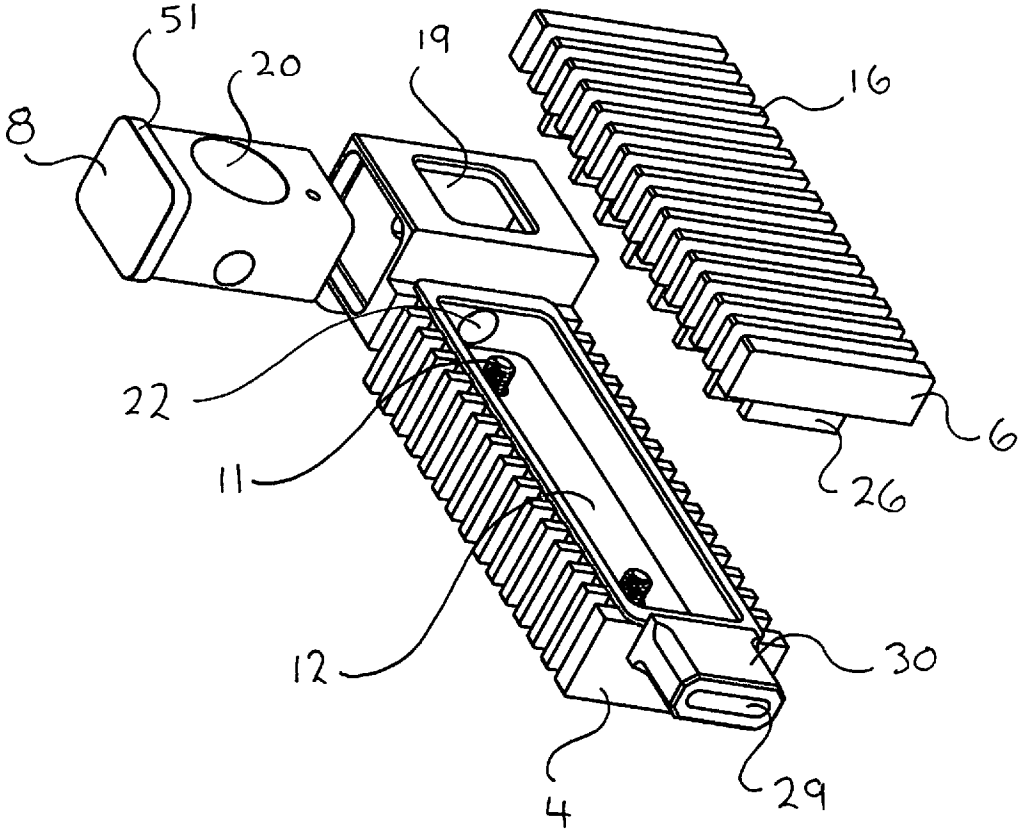
FIG. 5 is a top perspective exploded view of the pipe.
Figure 6:
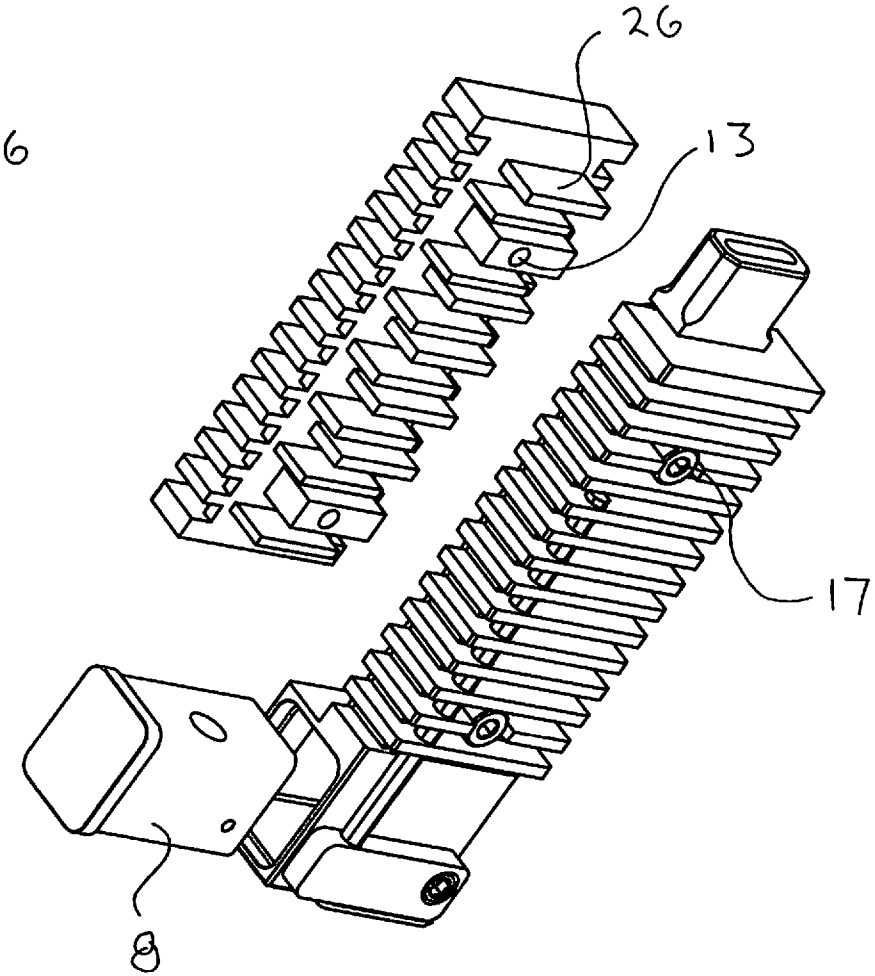
FIG. 6 is a bottom perspective exploded view of the pipe.
Figure 7:
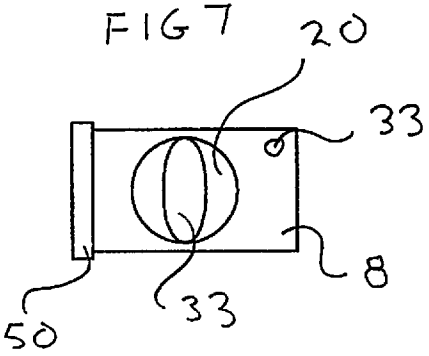
FIG. 7 is a top view of the removable, invertable bowl.
Figure 8:
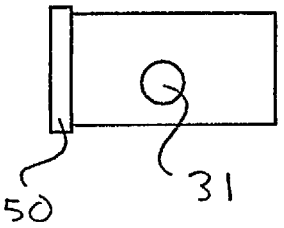
FIG. 8 is a front view of the removable, invertable bowl.
Figure 9:
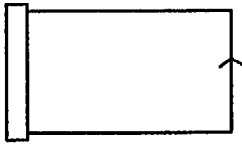
FIG. 9 is a bottom view of the removable, lockable, invertable bowl.
Figure 10:
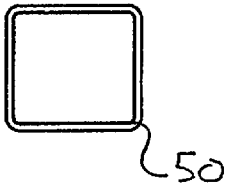
FIG. 10 is a right side view of the removable, lockable, invertable bowl.
Figure 11:
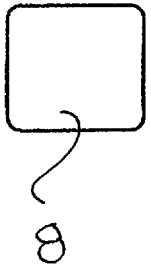
FIG. 11 is a left side view of the removable, lockable, invertable bowl.
Figure 12:
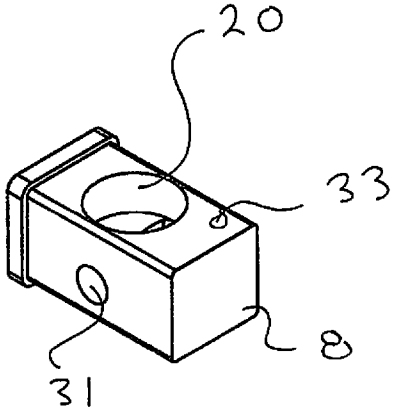
FIG. 12 is a top perspective view of the removable, lockable, invertable bowl.
Figure 13:
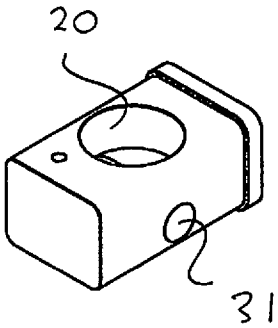
FIG. 13 is a bottom perspective view of the removable, lockable, invertable bowl.
Figure 14:
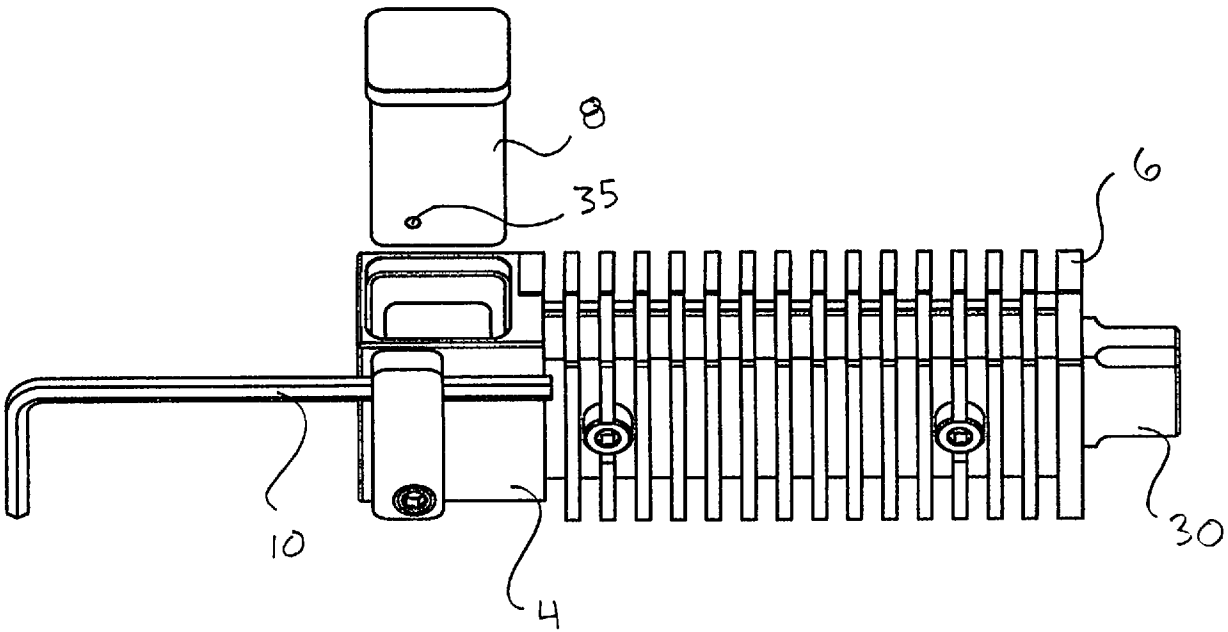
FIG. 14 is a bottom side perspective view of the pipe with the bowl and locking tool partially removed.

Looking at FIGS. 5 and 6, with the pipe 2 disassembled it can be seen that in its simplest configuration the pipe 2 has at the most, five parts. A pipe body 4, a top plate 6, a removeable, lockable, invertable bowl 8, a series of mechanical fasteners 11 (preferably two hex socket head screws and a hex head set screw) and an optional locking tool 10. In the preferred embodiment the pipe body 4 and top plate 6 will be machined from billet aluminum while the bowl 8 will be machined from brass, although other highly thermally conductive materials (generally metals with a coefficient of thermal conductivity greater than 40 Btu/(hr ft ° F.) at 77 degrees F. will be acceptable, although other materials may be used, they will not perform within an optimal range. Metal selection or passivation coatings may be utilized to minimize galvanic cell corrosion between the dissimilar metals. An optional polymer gasket (not illustrated) may be placed between the top plate 6 and the body 4 to ensure that no smoke is lost through the body 4/top plate interface 9. It is known that in alternate embodiments a peripheral lip and mating groove may be incorporated at this interface to eliminate the need for the optional gasket. When machined with a high degree of flatness and surface smoothness on the mating faces of the interface 9, there will be no need for any other sealing devices when the body 4 and top plate 6 are snugly bolted.

Looking closely at FIG. 5, the body 4 has a trough like smoke passage 12 formed along its longitudinal axis and two orifices 17 therethrough to accept mechanical fasteners 11 that extend into the passage 12 and threadingly engage in orifices 13 formed in two of the top plate internal fins 26. When tightened these fasteners 11 draw the body 4 and the top plate 6 together so as to enclose the smoke passage 12 on the top, bottom and sides, leaving the smoke to enter and exit at the ends of the smoke passage 12. (The region of the pipe between the bowl and the mouthpiece is often referred to as the shank section.)

The mouthpiece 30 extends only from the proximal end face of the body 2. At the distal end of the body 4 is the bowl housing 18 that has a top orifice 19 that aligns with the bore of the combustion chamber 20 cut into the bowl 8. The bowl housing 18 has two open sides to allow the sliding insertion of the bowl 8 from either side of the pipe 2. There is a draw orifice 22 extending between the bowl housing 18 and the distal end of the smoke passage. At the proximal end of the smoke passage 12 here is mouthpiece orifice 29 extending through the mouthpiece 30.

Looking at FIG. 6, one can see that there is a series of top plate internal fins 26 that extend normally from the bottom face of the top plate 6. This series of fins has a staggered configuration. None of the individual top plate internal fins 26 are long enough to extend across the entire width of the smoke passage 12 in the body 4. Rather, their configuration is staggered laterally such that each fin is offset laterally from the longitudinal axis of the pipe 2 with respect to all of their adjacent fins. This creates a serpentine path for the flow of smoke in the bore 16. This introduces the hot smoke to an increased amount of surface area to transfer its heat to. Explained in other terms. This series of top plate internal fins 26 is comprised of two sets of identical parallel fins interleaved with each other and with their linear axes offset from each other.

It is to be noted that in the preferred embodiment the machined tolerances of the top plate 6 and the body 4 are such that when assembled, the top plate internal fins 26 contact the face of the smoke passage 12. This additional contact aids in the dispersion of heat passing through the smoke passage by dividing its transfer surfaces approximately equally between the top plate 6 and the body 4.

Since the internal fins 26, and the external fins 16 on the top plate 6 are formed on the opposite sides of the same high heat transfer coefficient material, the heat generated within the combustion chamber 20 and transmitted to the top plate internal fins 26, is readily transferred the outer surface of the pipe 2 and its body external fins 14 and top plate external fins 16 surface from which this heat may be transferred to the ambient atmosphere. Similarly, the heat transmitted to the bottom top and side walls of the smoke passage 12 are transferred to the ambient atmosphere by these same external fins 14 and 16 of the pipe 2.

It is also to be noted that the path the smoke must traverse as it moves down the smoke passage 12, is a series of 180 degree alternating turns. These bends are sharp enough so that at the velocity the smoke travels down the smoke passage 12, much of the heavier tar, nicotine and smoke particles cannot navigate the tight turn radiuses and impact the walls of the pipe 2, plating out. This series of 180 degree alternating hairpin turns (bends) thus serves to eliminate much of the tars and particulate, from the smoke charge. Since the turns are alternating in direction, particulate that does not impact the smoke passage walls at the first bend are channeled to the outer side of the smoke path such that when they reach the next hairpin bend, they have an even tighter radius to navigate and are likely to strike the walls of the of the smoke passage.

This reduction in tar, nicotine and smoke particulate, enhances the flavor of the smoke charge and eases the impact of the smoker's lungs. Since the top plate 6 and the body 4 can be disassembled, the buildup of the tar and smoke particles can be routinely removed by washing the pipe components. Since the pipe is made of aluminum, it may steam cleaned, put in a dishwasher or soaked to clean without any distortion or damage to the pipe 2.

Figure 15:
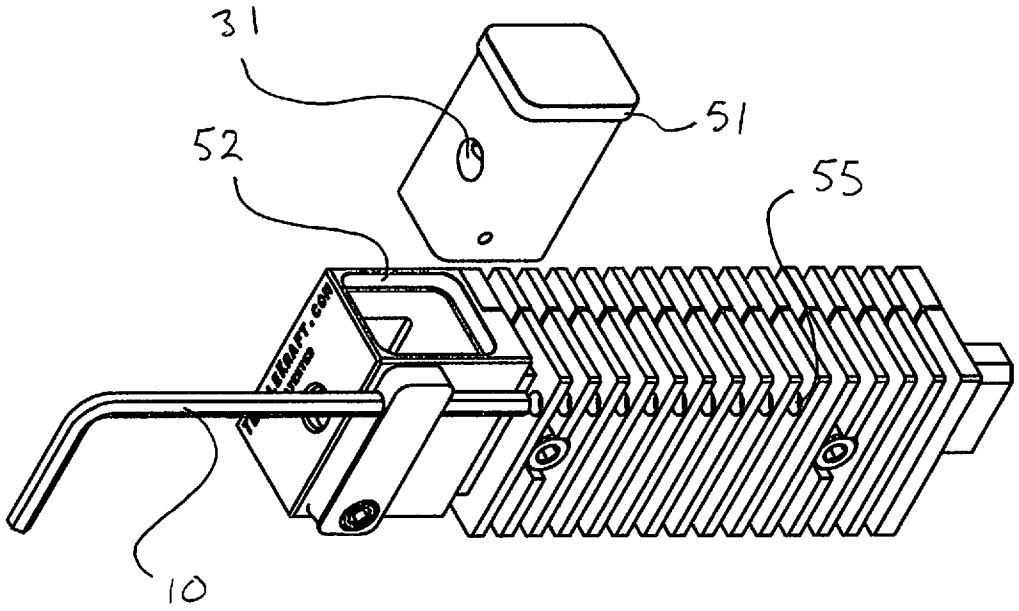
FIG. 15 is a bottom end perspective view of the pipe with the bowl and locking tool partially removed

As FIGS. 7-11 illustrate, the bowl 8 is configured as a rectangular cuboid and has a generally cylindrical bore forming a combustion chamber 20 formed therein. There is a bowl orifice 31 extending normally from the vertical axis of the combustion chamber 20, at the bottom of its cylindrical bore, through the end wall of the bowl 8. This opens to a semicircular trough along the bottom of the combustion chamber 20. (FIG. 7) This aligns with the draw orifice 22 formed through the bowl housing of the body 4 and connects the smoke passage 12 to the combustion chamber 20. (FIG. 5) Horizontal alignment of the bowl orifice 31 with the draw orifice 22 is ensured by the stop flange 51 formed about the perimeter of one of the side faces of the bowl 8. (FIGS. 7, 8 and 10) This stop flange 51 abuts and aligns with a recess 52 cut on one of the side edges of the bowl housing 18. (FIGS. 5 and 15)

The bowl 8 matingly and frictionally engages the inner walls of the bowl housing 18 of the body 2. The bowl 8 also fits into the bowl housing inverted. In this configuration the bowl 8 may be packed with a slug of combustible material and transported without loss.

Looking at FIGS. 12-15 it can be seen that there is a first indentation 33 on the top face of the bowl 8. There is also a second indentation 35 on the bottom face of the bowl 8 (FIG. 14) to receive a mechanical fastener 11 (preferably a hex head set screw) that is threadingly engaged through a recess in the bottom face of the body 4 so as to extend into the bowl housing 12, and frictionally engage the first or second indentations on the bowl 8. On the bottom side of the body is a storage system that frictionally constrains a locking tool 40 (hex wrench) that is sized for engaging the set screw that secures the bowl 8 in the bowl housing 18 for the transport of the pipe 2 when a fresh slug of combustible material is placed in the bore of the combustion chamber and the bowl 8 is inverted in the bowl housing 12. The hex wrench also is sized for operational engagement with the other mechanical fasteners 11. (FIGS. 4 and 5)

When the bowl 8 is placed in the transport configuration (inverted) and locked in with the mechanical fastener 11, the distal and proximal ends of the bowl orifice 31 will be blocked by the side walls of the bowl housing 18.

In the bowl housing section 18 at the end face of the body, there is a carburetor orifice 50 (FIG. 15) that aligns with the bowl orifice 31. This allows the user to regulate the velocity and volume of air drawn into the pipe 2 so as to regulate the temperature of the incoming charge as well as its ratio of smoke to air. It is to be noted that the bowl orifice 31 extends out both sides of the bowl 8 such that the draw orifice 22 will simultaneously align with the bowl's bore and the carburetor orifice 50 via the bowl orifice 31, when in the smoking configuration.

In operation, a slug of combustible material is packed into the combustion chamber 20 of the bowl 8 and with the pipe 2 inverted, the bowl 8 inserted into the bowl housing section 18. The locking tool engages the mechanical fastener 11 on the bottom face of the body 4 so as to extend into the bowl housing 12, and frictionally engage the second indentation on the bowl 8. This allows the user to transport the pipe 2 and its combustible material safely and without loss.

The pipe 2 is transported to a location where the user wishes to smoke. The bowl 8 is removed from the bowl housing 18 by the removal of the mechanical fastener 11 with the locking tool 40, the pipe 2 is flipped 180 degrees and the bowl 8 is reinserted into the bowl housing section 18 until stop flange 51 abuts and aligns with the recess 52 cut on one of the side edges of the bowl housing 18. In this position the carburetor orifice 50, the bowl orifice 3 and the draw orifice 22 all align. The locking tool 40 tightens the mechanical fastener 11 into the second indentation 33 on the bowl and the pipe 2 is operational. The locking tool 40 is frictionally restrained within its array of storage orifices 55 formed through the body external fins 14 (FIG. 15.) The user places their finger over the carburetor orifice 50 and ignites the combustible material in the combustion chamber 20 while drawing air through the mouthpiece. The user covers and eposes the carburetor orifice 50 as desired. As the combustion heat travels down the pipe 2 via both convection and conduction heat transfer, it is readily transferred to the outside of the pipe's body where it is disbursed to the ambient atmosphere, maintaining the pipe's cool exterior temperature as well as cooling the charge s smoke before it reaches the mouthpiece 30.

While certain features and aspects have been described with respect to exemplary embodiments, one skilled in the art will recognize that numerous modifications are possible.

Having thus described the invention, what is claimed as new and desired to be secured by Letters Patent is as follows:

1. A pipe comprising:

a pipe body having a distal end and a proximal end;

a top plate mechanically attachable to said pipe body so as to define a smoke passage between the distal end and the proximal end of said pipe body;

a bowl housing formed in the distal end of said pipe body;

a mouthpiece formed in the proximal end of said pipe body;

a bowl, removably insertable within said bowl housing; and a plurality of external fins arranged along an entire length of the smoke passage between the bowl housing and the mouthpiece and coupled to the smoke passage to conduct heat away from the smoke passage.

2. The pipe of claim 1, wherein the plurality of external fins further comprises:

a first series of parallel external fins extending normally from an outer surface of said pipe body; and a second series of parallel external fins extending normally from an outer surface of said top plate.

3. The pipe of claim 2 further comprising at least one mechanical fastener to affix said top plate to said pipe body and a locking tool to operatively engage said mechanical fastener, said locking tool frictionally affixable within said first series of parallel external fins extending normally from an outer surface of said pipe body.

4. The pipe of claim 1 further comprising a set of internal fins extending normally from an inner surface of said top plate so as to extend into said smoke passage.

5. The pipe of claim 4, wherein the internal fins are offset laterally from a longitudinal axis of the pipe to define a serpentine path through the smoke passage between the bowl housing and the mouthpiece.

6. The pipe of claim 4 wherein said pipe has a linear axis and said internal fins reside parallel with adjacent fins but not in axial alignment with adjacent fins with respect to the linear axis of said pipe.

7. The pipe of claim 1 wherein said bowl is invertable within said bowl housing.

8. The pipe of claim 1 wherein said bowl is lockable within said bowl housing.

9. The pipe of claim 1 further comprising;

a carburetor orifice formed in said distal end of said bowl housing formed on said distal end of said pipe body;

a bowl orifice extending through said bowl; and a draw orifice extending into said bowl housing from said smoke passage;

wherein when said bowl is inserted into said bowl housing, said draw orifice, said bowl orifice and said carburetor orifice align.

10. The pipe of claim 1, wherein the pipe body, the top plate, and the plurality of external fins comprise metal.

11. A pipe comprising:

a pipe body having a distal end and a proximal end;

a top plate mechanically attachable to said pipe body so as to define a smoke passage between the distal end and the proximal end of said pipe body;

a bowl housing formed in the distal end of said pipe body;

a mouthpiece formed in the proximal end of said pipe body;

a bowl, removably insertable within said bowl housing; and a set of internal fins extending normally from an inner surface of said top plate so as to extend into said smoke passage.

12. The pipe of claim 11, wherein the internal fins are offset laterally from a longitudinal axis of the pipe to define a serpentine path through the smoke passage between the bowl housing and the mouthpiece.

13. A pipe comprising:

an externally finned, rectangular cylinder having a distal end and a proximal end with a smoke passage defined there between;

a mouthpiece extending from said proximal end;

a bowl slidingly insertable into a matingly conformed axial through-recess in said distal end of said cylinder.

14. The pipe of claim 13 further comprising a series of uninterrupted fins extending normally from the exterior faces of said rectangular cylinder.

15. The pipe of claim 14 wherein said fins are parallel to said adjacent fins.

16. The pipe of claim 15 further comprising a series of internal fins extending into said smoke passage.

17. The pipe of claim 16 wherein said bowl is invertible in said through-recess.

18. The pipe of claim 17 wherein said bowl is lockable in said through-recess.

19. A pipe comprising:

a washable, internally finned, rectangular cylinder having a distal end and a proximal end with a smoke passage defined there between;

a mouthpiece extending from said proximal end;

a bowl slidingly insertable into a matingly conformed axial through-recess in said distal end of said cylinder;

wherein said smoke passage defines a series of hairpin turns of alternating direction to remove particulate from smoke drawn down the smoke passage from said bowl to said mouthpiece.

20. The pipe of claim 19 further comprising a series of heat dispersing fins extending normally from at least one of an external surface of said pipe.

* * * * *